US006886253B2

(12) United States Patent
Chan

(10) Patent No.: US 6,886,253 B2
(45) Date of Patent: May 3, 2005

(54) FOIL CUTTER

(76) Inventor: Wai Chan, Flat A, 16th Floor, Shun On Mansion, Taikoo Shing (HK)

( * ) Notice: Subject to any disclaimer, the term of this patent is extended or adjusted under 35 U.S.C. 154(b) by 0 days.

(21) Appl. No.: 10/637,573

(22) Filed: Aug. 11, 2003

(65) Prior Publication Data

US 2004/0255464 A1 Dec. 23, 2004

(30) Foreign Application Priority Data

Jun. 23, 2003 (HK) ..... 03104495

(51) Int. Cl.[7] ..... B67B 7/00
(52) U.S. Cl. ..... 30/1.5; 30/102
(58) Field of Search ..... 30/1.5, 101, 102, 30/243, 417, 418; 81/3.09, 3.07; 82/70.2, 75

(56) References Cited

U.S. PATENT DOCUMENTS 4,845,844 A 7/1989 Allen
5,243,760 A * 9/1993 May, Jr. ..... 30/101
5,351,579 A * 10/1994 Metz et al. ..... 81/3.2
5,528,830 A * 6/1996 Hansen ..... 30/97
5,653,023 A 8/1997 Andina
5,920,989 A * 7/1999 Taylor ..... 30/101
6,477,775 B2 * 11/2002 Scribner et al. ..... 30/1.5
6,658,739 B1 * 12/2003 Huang ..... 30/96

FOREIGN PATENT DOCUMENTS

GB 2322125 8/1998

* cited by examiner

*Primary Examiner*—Kenneth E. Peterson
*Assistant Examiner*—Omar Flores Sánchez
(74) *Attorney, Agent, or Firm*—Burns, Doane, Swecker & Mathis, L.L.P.

(57) ABSTRACT

A foil cutter including first and second foil cutting means, said first and second cutting means being relatively movable towards each other for foil cutting engagement with the neck of a bottle, wherein, at least one of said cutting means including a pair of pivotally movable cutting members.

20 Claims, 2 Drawing Sheets

FOIL CUTTER

FIELD OF THE INVENTION

The present invention relates to foil cutters and, more particularly, to foil cutters suitable for removing a sealing foil from the neck of a wine bottle.

BACKGROUND OF THE INVENTION

Bottled wines are usually sealed with a foil which covers the head portion of a bottle wine. Before wine can be served from a sealed wine bottle, the sealing foil and the cork have to be removed. Foil cutters for removing foil from the neck of a wine bottle are well known and are a common household item.

For example, U.S. Pat. No. 4,845,844 describes a foil cutter with a plurality of cutting wheels distributed around the perimeter of a circle. The foil cutter includes a bifurcated hand piece in which two cutting wheels are disposed on corresponding opposite sides on the bifurcated arms. The bifurcated arms are resiliently movable towards each other so that the plurality of cutting wheels can move into cutting engagement with the sealing foils.

U.S. Pat. No. 5,653,023 describes a foil cutter with a U-shaped body and a sharp metal cutting blade that is substantially curved in a semi-circular shaped disposed on each side of the U-shaped body.

United Kingdom Patent Publication GB 2,322,125A describes a foil cutter with an annular casing 17 and with a central passage 14 to accommodate the neck of a wine bottle. In use, a pair of cutting members such as wheels can be urged into engagement with a bottle neck in the passage by the relative movement of at least one of the cutting members.

Those commonly known foil cutters are not satisfactory and it is desirable if improved foil cutters can be provided.

OBJECT OF THE INVENTION

Accordingly, it is an object of the present invention to provide improved foil cutting means or foil cutters. At a minimum, it is an object of the present invention to provide the public with a useful choice.

SUMMARY OF THE INVENTION

According to the present invention, there is provided a foil cutter including first and second foil cutting means, said first and second cutting means being relatively movable towards each other for foil cutting engagement with the neck of a bottle, wherein, at least one of said cutting means including a pair of pivotally movable cutting members.

To improve tracking of the cutting means on the sealing foil, in one preferred embodiment, both said first and second cutting means include a pair of pivotally mounted cutting blades, the cutting edges of said pivotally movable cutting blades of said first and said second cutting means being substantially coplanar.

In a preferred embodiment, five cutting wheels or members are disposed on the housing of the foil cutter so that a foil on a wine bottle can be cut by turning said foil cutter by around 72°–74°.

As an example of appropriate pivotally movable cutting members, the foil engaging edges of said pivotal pair of cutting blades of said cutting means being intermediate of the neck of the bottle to be engaged and the pivotal hinge between said pivotal pair of blades during normal use.

Preferably, each cutting blade of said pair of cutting blades being substantially equidistant from the pivotal hinge between, so that the cutting foils can be more evenly distributed between the pair of cutting blades.

Preferably, the foil engaging edges of said pivotal pair of cutting blades of said cutting means being intermediate of the neck of the bottle to be engaged and the pivotal hinge between said pivotal pair of blades during normal use.

Preferably, said pivotal pair of cutting blades being under spring bias so that when said pair of cutting blades are moved from a spring neutral position, said spring urge will return said pair of cutting blades to their spring neutral position.

Preferably, said pair of pivotally mounted cutting blades being adapted to surround and contiguous contact the outer side of said neck of said bottle during cutting engagement between said foil cutter and said bottle.

Preferably, said cutting blades are disposed so that, when a pair of said cutting blades about a said pivotal hinge engage with the outer side of a bottle, the arc of cutting engagement about said pivotal hinge being less than half the perimeter of said bottle neck.

Preferably, said cutting blades which are pivotable about said pivotal hinge being cutting wheels, said cutting wheels being freely rotatable about its centre.

Preferably, during cutting engagement, said centres of said cutting wheels, the axis of said pivotal hinge and the centre of said bottle neck of the preferred embodiment form the vertices of a parallelogram with said axis of said pivotal hinge and said centre of said bottle being at opposite ends.

Preferably, the centres of said pair of cutting wheels and the axis of said pivotal hinge which is between said cutting wheels together form the vertices of an isosceles triangle.

Preferably, said pivotally mounted cutting wheels being adapted to follow the outer curvature of said bottle neck during cutting engagement.

In another preferred embodiment, the foil cutter includes an additional cutting blade, said additional cutting blade being intermediate of said first and second pivotally movable foil cutting means so that, during cutting engagement, said first cutting means, said second cutting means and said additional cutting blade engage on the neck of the bottle.

Preferably, during non-cutting engagement conditions, the cutting edges of said first cutting means, said second cutting means and said additional cutting blade being disposed along the circumference of a circle which is slightly larger than the outer diameter of the neck of a wine bottle.

Preferably, said first and second foil cutting means being disposed for engaging on opposite sides of the neck of a bottle for foil cutting engagement with the outer side of said neck of said bottle, said first and second cutting means include cutting edges which are relatively movable towards each other, at least one of said cutting means includes a pair of cutting blades which are pivotally movable about said housing and about a pivotal hinge.

Preferably, said pair of pivotally mounted cutting blades being adapted to surround and contiguous contact the outer side of said neck of said bottle during cutting engagement between said foil cutter and said bottle.

Preferably, said pivotal hinge being intermediate said pair of cutting blades.

Preferably, said foil cutting includes an additional cutting blade disposed intermediate of said first and second pivotally movable foil cutting means so that, during cutting engagement, said first cutting means, said second cutting means and said additional cutting blade engage on the neck of the bottle.

Preferably, the free ends of said bifurcated arms include spacing means to reduce excessive stress on the common pivotal joint between said bifurcated arms.

BRIEF DESCRIPTION OF THE DRAWINGS

Preferred embodiments of the present invention will be explained in further detail below by way of examples and with reference to the accompanying drawings, in which.

DETAILED DESCRIPTION OF THE PREFERRED EMBODIMENTS

Figure 1:
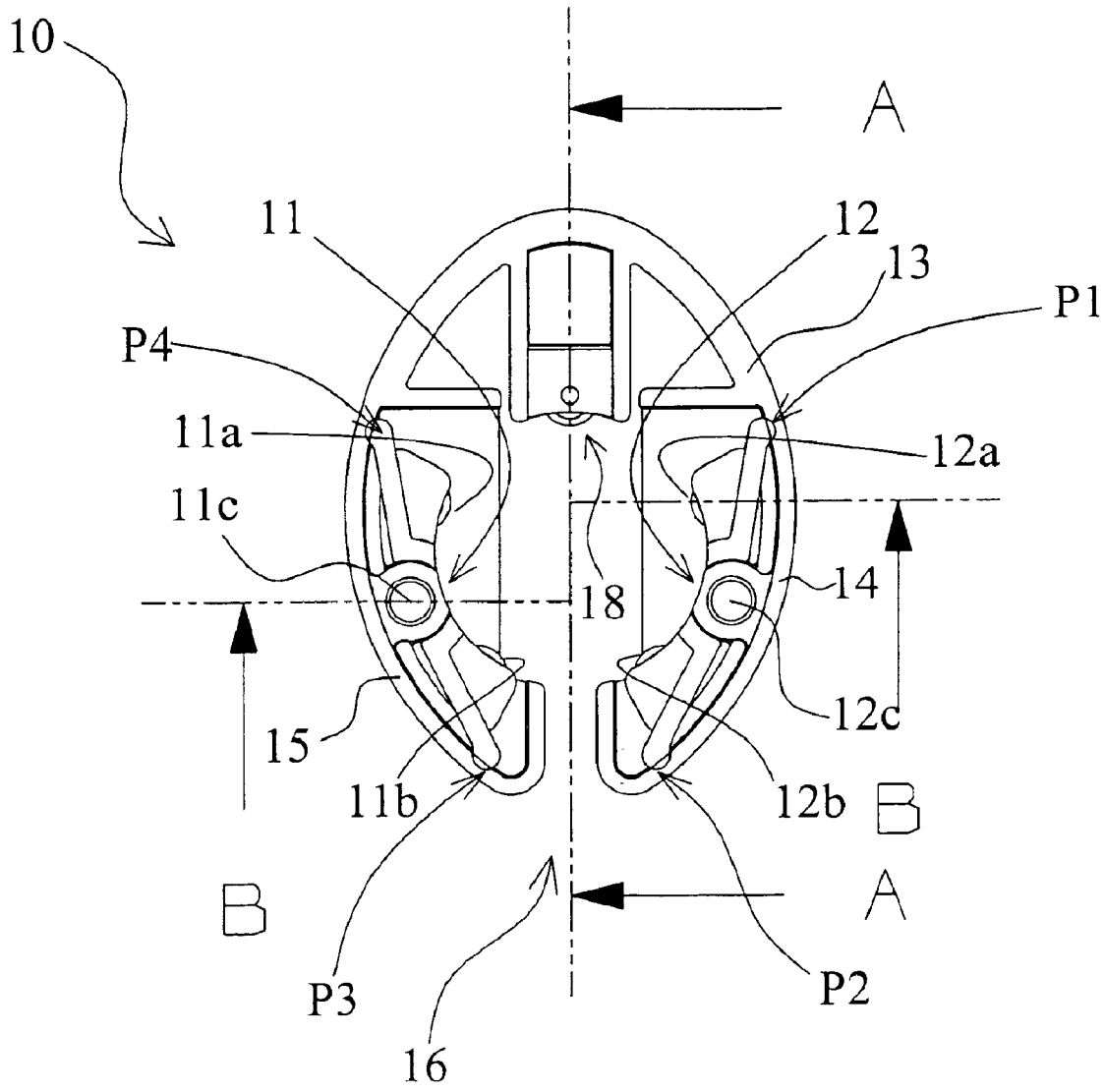
FIG. 1 is an elevation view of a foil cutter showing a preferred embodiment of the present invention.
Figure 2:
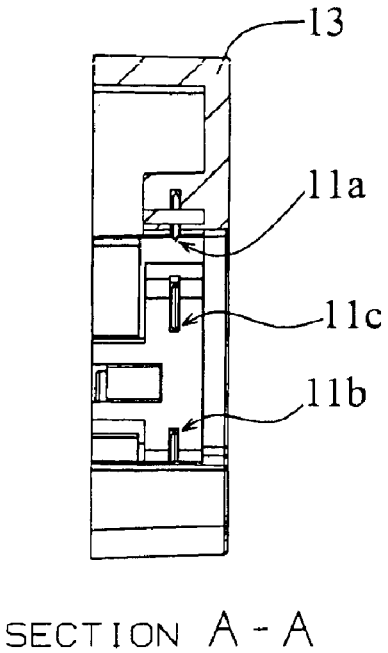
FIG. 2 is a side view of FIG. 1 taken along the section A—A.
Figure 3:
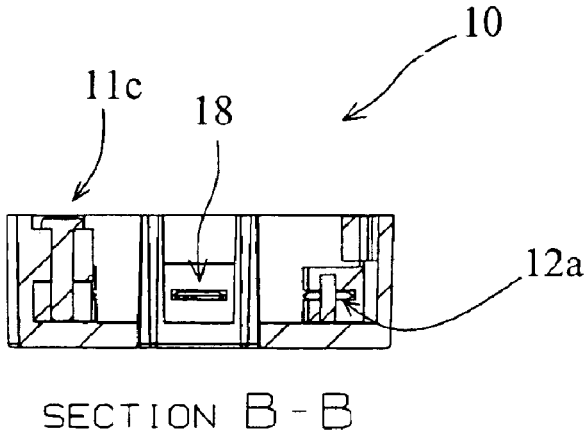
FIG. 3 is a cross-sectional view of the foil cutter of FIG. 1 taken along the line B—B.
Figure 4:
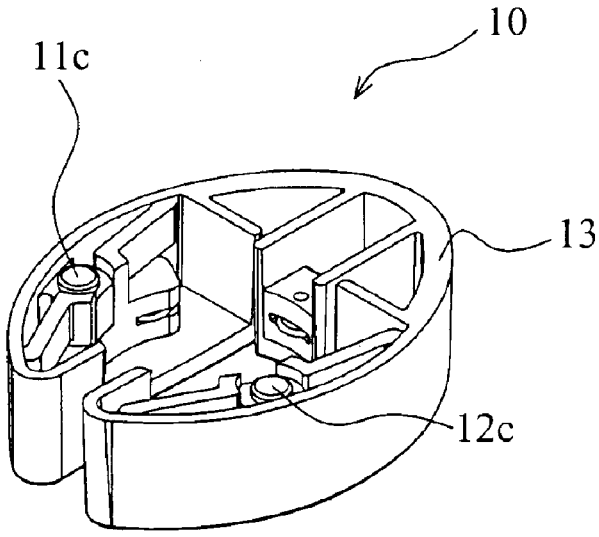
FIG. 4 is a perspective view of the foil cutter of FIG. 1 when viewed from below.

Referring to the Figures, there is shown a foil cutter 10 including first 11 and a second 12 cutting means which are mounted on a housing 13. The housing 13 includes a compartment for receiving the top of a bottle. The first 11 and the second 12 cutting means are disposed on opposite sides of the compartment and can be urged towards each other for cutting engagement with the neck of a wine bottle.

The housing 13 includes bifurcated arms 14, 15 which are joined together at one of their ends and to the base of the housing. The bifurcated arms 14, 15 are generally curved towards each other and define the periphery of a compartment for receiving the top portion of a wine or other bottle. A gap 16 is formed between the free ends of the bifurcated arms 14 and 15. This gap 16 generally limits the maximum amplitude of the relative movements of the bifurcated arms 14, 15 towards each other. The housing 13 is made of a rigid material with an appropriate degree of resilience or elasticity so that the curve bifurcated arms 14, 15 can move towards each other and into cutting engagements when urged together. When the urging force has been released, the bifurcated arms will restore to their spring neutral position. The housing 13 can be made of, for example, hard plastics, such as polycarbonate and TR90, or metal, such as steel or stainless steel.

Each of first 11 and the second 12 cutting means include a pair of cutting members, 11*a* and 11*b*, 12*a* and 12*b*. Each of the cutting member pairs, 11*a* and 11*b*, 12*a* and 12*b*, are mounted on a mounting frame 17 which is in turn mounted pivotally on a pivotal hinge 11*c*, 12*c* so that the cutting members are pivotally movable with respect to the pivotal hinge which is between the pair of cutting members. As can be seen from the Figures, the cutting members are disposed so that the pivotal hinge is intermediate of the cutting members so that when one of the cutting members advances towards the centre line A—A of the main housing, the other cutting member of the cutting pair will retreat from the centre line A—A. The cutting members, 11*a, b* and 12*a, b*, are cutting wheels which are freely rotatable about their respective axes.

The cutting wheels are also mounted on their respective mounting frames. Each of the cutting wheels is sandwiched between supporting platforms so that the stress on the non-cutting surfaces of the cutting wheels due to upward movements of the foil cutter during removal of sealing foils can be distributed more evenly on the surfaces of the cutting wheels, rather than concentrating along the axes of the rotating wheels. Also, to distribute the stress on the mounting frame, the mounting frame is formed with stress distributing platforms which, when sandwiched between the corresponding pair of stress distributing platforms on the supporting ears of the pivotal hinges 11*c*, 12*c*, will help to distribute the stress between the mounting frames 17 and their respective hinges to alleviate wear and tear.

In order to return the pivotal pair of cutting wheels to their initial positions, spring biasing means are connected to the mounting frames so that the mounting frames will be returned to their spring neutral positions after the engaging force on the mounting frames has been removed. The spring biasing means for this purpose in this embodiment is a wing-shaped plate-typed spring as shown in the Figures.

The cutting wheels on each cutting means are substantially equidistant from the pivotal hinge so that the cutting stress can be evenly distributed or shared by the cutting wheels. Also, it will be noted that cutting edges of the cutting wheels are intermediate of the centre line A—A and the respective pivotal hinge.

To reduce the turning angle that is necessary to complete a revolution of the foil cutter for the removal of a sealing foil, an additional cutting means is disposed intermediate of the first 11 and the second 12 cutting means. This third cutting means projects from a base which extends from the joint or the base housing between the bifurcated arms.

Like the other cutting members, this third cutting means also includes a freely rotatable cutting wheel. It will be noted from FIG. 1 that the cutting edges of the five cutting members, i.e., 11*a*, 11*b*, 12*a*, 12*b* and 18, are disposed on the perimeter of an imaginary circle. This imaginary circle is slightly larger than the dimension of the bottle top to be engaged so that the bottle head can be comfortably received by the compartment before the cutting wheels are urged into cutting engagement with the outside of the bottle neck. The mounting base of the cutting member 18 also provide additional strength to the base portion of the housing which is subject to repetitive stress during repeated urging and releasing of the bifurcated arms for cutting and removal of sealing foils from wine bottles.

To reduce stress on a user's wrist when using a foil cuter, it is highly desirable if foil cutting can be completed with a foil cutter turned by less than 90° and preferably less than 80°. In the present embodiment, the cutting wheels are substantially evenly distributed around the perimeter of an imaginary circle so that a cutting angle of about 72° can be achieved. As the angular disposition of the cutting wheels may not be quite exactly equal due to the gap 16, this turning angle may be in the region of 75°. The disposition of 5 cutting wheels is optimised between cost and user comfort since additional cutting wheels will mean additional costs.

Turning now to the normal use of the foil cutting. When the sealing foil of a bottle is to be removed, the foil cutter will be aligned with the bottle head so that the receiving compartment of the foil cutter will accommodate the head of the bottle. As the cutting edges of the cutting means are distributed generally along the perimeter of an imaginary circle which is slightly larger than the dimension of the bottle head, the bottle head can be comfortably received within the receiving compartment. When the bifurcated arms 14, 15 are urged towards each other, the cutting edges of the cutting members will move into cutting engagement with the bottle neck. The sealing foil can be cut and removed when the cutting edges on the foil cutter have made a complete revolution. To minimize the necessary angular movement of the foil cutter, the cutting edges of the cutting members are substantially coplanar.

Thus, as can be seen from the description above, the foil cutter of the present invention includes first and second cutting means. The first and the second cutting means are relatively movable towards each other for foil cutting engagement with the neck of a wine bottle. It will be appreciated that the pivotally movable first and second cutting means provide improved tracking of the cutting edges of the cutting means on the periphery of the bottle neck when under cutting engagement. This enhanced tracking flexibility during cutting engagement provides advantage over conventional foil cutters so that bottle necks with a less perfect circular periphery or bottles with an increased range of dimensions can be handled by a single foil cutter.

While both first and second cutting means comprise a pair of pivotally movable cutting members mounted on a common hinge, it will be appreciated that, to provide enhanced tracking of the cutting means on the neck of a bottle, it is sufficient if at least one of the cutting means includes a pair of pivotally movable cutting members.

While the present invention has been explained by reference to the preferred embodiments described above, it will be appreciated that the embodiments are only illustrated as examples to assist understanding of the present invention and are not meant to be restrictive on its scope. In particular, the scope, ambit and spirit of this invention are meant to include the general principles of this invention as inferred or exemplified by the embodiments described above. More particularly, variations or modifications which are obvious or trivial to persons skilled in the art, as well as improvements made on the basis of the present invention, should be considered as falling within the scope and boundary of the present invention.

Furthermore, while the present invention has been explained by reference to a foil cutter, it should be appreciated that the invention can apply, whether with or without modifications, to other foil cutter means or wine opener incorporating a foil cutter or foil cutting means without loss of generality.

What is claimed is:

1. A foil cutter comprising first and second foil cutting arms connected at one end, said first and second cutting arms being relatively movable towards each other for foil cutting engagement with the neck of a bottle, wherein a first one of said cutting arms includes a pair of cutting members pivotally mounted to the first cutting arm by a hinge located between the two cutting members such that the cutting members are pivotable relative to the first cutting arm.

2. A foil cutter according to claim 1, wherein both said first and second cutting arms include a pair of pivotally mounted cutting blades, the cutting edges of said pivotally movable cutting blades of said first and said second cutting arms being substantially coplanar.

3. A foil cutter according to claim 2, wherein each cutting blade of said pair of cutting blades is substantially equidistant from the hinge between them.

4. A foil cutter according to claim 3, wherein the foil engaging edges of said pivotal pair of cutting blades of said cutting arms are intermediate the neck of the bottle to be engaged and the pivotal hinge between said pivotal pair of blades during normal use.

5. A foil cutter according to claim 4, wherein said pivotal pair of cutting blades being under spring bias so that when said pair of cutting blades are moved from a spring neutral position, said spring urge will return said pair of cutting blades to their spring neutral position.

6. A foil cutter according to claim 2, wherein said pair of pivotally mounted cutting blades are adapted to surround and contiguously contact the outer side of said neck of said bottle during cutting engagement between said foil cutter and said bottle.

7. A foil cutter according to claim 6, wherein said cutting blades are disposed so that, when a pair of said cutting blades about a hinge engage with the outer side of a bottle, the arc of cutting engagement about said pivotal hinge is less than half the perimeter of said bottle neck.

8. A foil cutter according to claim 7, wherein said cutting blades which are pivotable about said pivotal hinge are cutting wheels, said cutting wheels being freely rotatable about their centers.

9. A foil cutter according to claim 8, wherein, during cutting engagement, said centres of said cutting wheels, the axis of said pivotal hinge and the centre of said bottle neck form the vertices of a parallelogram with said axis of said pivotal hinge and said centre of said bottle being at opposite ends.

10. A foil cutter according to claim 9, wherein the centres of said pair of cutting wheels and the axis of said pivotal hinge which is between said cutting wheels together form the vertices of an isosceles triangle.

11. A foil cutter according to claim 8, wherein said pivotally mounted cutting wheels being adapted to follow the outer curvature of said bottle neck during cutting engagement.

12. A foil cutter according to claim 1 and including an additional cutting blade, said additional cutting blade being intermediate of said first and second pivotally movable foil cutting arms so that, during cutting engagement, said first cutting arm, said second cutting arm and said additional cutting blade engage on the neck of the bottle.

13. A foil cutter according to claim 12, wherein, during non-cutting engagement conditions, the cutting edges of said first cutting arm, said second cutting arm and said additional cutting blade are disposed along the circumference of a circle which is slightly larger than the outer diameter of the neck of a wine bottle.

14. A foil cutter according to claim 1 and including a housing, wherein said first and second foil cutting arms are disposed for engaging on opposite sides of the neck of a bottle for foil cutting engagement with the outer side of said neck of said bottle, said first and second cutting arms include cutting edges which are relatively movable towards each other and at least one of said cutting arms includes a pair of cutting blades which are pivotally movable about said housing and about a pivotal hinge.

15. A foil cutter according to claim 14, wherein said pivotal hinge being intermediate of said pair of cutting blades.

16. A foil cutter according to claim 14, wherein said pair of pivotally mounted cutting blades are adapted to surround and contiguously contact the outer side of said neck of said bottle during cutting engagement between said foil cutter and said bottle.

17. A foil cutter of claim 16, wherein said pivotal hinge being intermediate said pair of cutting blades.

18. A foil cutter of claim 16 and including an additional culling blade disposed intermediate of said first and second pivotally movable foil cutting arms so that, during cutting engagement, said first cutting arm, said second cutting arm and said additional cutting blade engage on the neck of the bottle.

19. A foil cutter of claim 16, wherein the free ends of said bifurcated arms include spacing means to reduce excessive stress on the common pivotal joint between said bifurcated arms.

20. A foil cutter according to claim 1 and including a housing, wherein five cutting members are disposed on said housing so that a foil on a wine bottle can be cut by turning said foil cutter by around 72°–74°.

* * * * *